US006383991B1

(12) United States Patent
Hashimoto et al.

(10) Patent No.: US 6,383,991 B1
(45) Date of Patent: May 7, 2002

(54) CUTTING OIL COMPOSITION

(75) Inventors: Jiro Hashimoto; Toshiya Hagihara; Kazuhiko Nishimoto, all of Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 09/647,592

(22) PCT Filed: Apr. 2, 1999

(86) PCT No.: PCT/JP99/01737

§ 371 Date: Nov. 27, 2000

§ 102(e) Date: Nov. 27, 2000

(87) PCT Pub. No.: WO99/51711

PCT Pub. Date: Oct. 14, 1999

(30) Foreign Application Priority Data

Apr. 3, 1998 (JP) ..... 10-092080
May 8, 1998 (JP) ..... 10-126428
Jul. 31, 1998 (JP) ..... 10-217207

(51) Int. Cl.[7] ..... C10M 105/08; C10M 107/34; C10M 125/26

(52) U.S. Cl. ..... 508/161; 508/579; 508/58; 72/42

(58) Field of Search ..... 508/161, 579, 508/580; 72/42

(56) References Cited

U.S. PATENT DOCUMENTS 4,212,750 A * 7/1980 Gorman ..... 508/562
4,521,326 A * 6/1985 Seibert et al. ..... 252/74
4,828,735 A * 5/1989 Minagawa et al. ..... 508/579
4,971,722 A * 11/1990 Philippsen ..... 252/73
5,120,708 A * 6/1992 Melear et al. ..... 507/126
5,580,845 A * 12/1996 Ruane ..... 508/161
5,652,204 A * 7/1997 Cracknell ..... 508/562
5,792,727 A * 8/1998 Jacobs ..... 508/113
6,054,422 A * 4/2000 Ward et al. ..... 508/579

FOREIGN PATENT DOCUMENTS

| | | |
|---|---|---|
| JP | 54061380 | 5/1979 |
| JP | 2029496 | 1/1990 |
| JP | 3181598 | 8/1991 |
| JP | 8259978 | 8/1996 |
| JP | 9059666 | 3/1997 |
| JP | 10060468 | 3/1998 |

* cited by examiner

*Primary Examiner*—Jacqueline V. Howard
(74) *Attorney, Agent, or Firm*—Birch, Stewart, Kolasch & Birch, LLP

(57) ABSTRACT

The present invention relates to a cutting oil comprising (a) a polyether compound represented by the formula (I):

$$R_1O(EO)_m(AO)_nR_2 \quad (I)$$

wherein each of $R_1$ and $R_2$, which may be identical or different, is hydrogen atom or a hydrocarbon group having 1 to 24 carbon atoms, at least one of which is a hydrocarbon group; EO is oxyethylene group; AO is an oxyalkylene group having 3 or 4 carbon atoms; and each of m and n is 1 to 50, wherein a sum of m and n is from 4 to 100; a cutting oil composition comprising the above cutting oil and an abrasive; a cutting method using the above cutting oil composition; and a process of cleaning a wafer, comprising the steps of cleaning a wafer obtainable by cutting an ingot with a wire saw using the above cutting oil composition; heating the resulting waste water to a temperature equal to or higher than a cloud point of a polyether compound represented by the formula (I) contained in the waste water, to allow separation into an oil phase and an aqueous phase; and removing the oil phase comprising the polyether compound from the waste water. According to the present invention, there can be obtained excellent dispersibility of the abrasive, and excellent re-dispersibility, cutting performance and workability when sedimented, and the object to be cut obtained after cutting can be easily cleaned.

13 Claims, No Drawings

CUTTING OIL COMPOSITION

This application is the national phase under 35 U.S.C. §371 of PCT International Application No. PCT/JP99/01737 which has an International filing date of Apr. 2, 1999, which designated the United States of America.

TECHNICAL FIELD

The present invention relates to a cutting oil usable when cutting an object to be cut (including machined product) with a wire saw utilizing free abrasive grains, which can improve cutting performance and workability, a cutting oil composition comprising the cutting oil and an abrasive, a cutting method using the cutting oil composition, and a process for cleaning a wafer obtainable by the cutting method.

BACKGROUND ART

Conventionally, when a silicon ingot or the like is cut with a wire saw by utilizing free abrasive grains, to manufacture a sliced product, there is used a non-water-soluble cutting oil comprising a mineral oil as a main component. After the cutting, in order to clean to remove the clung non-water-soluble cutting oil which is deposited on the sliced product, there are employed organic solvents and specialized detergents.

In order to simplify cleaning of the above sliced product, there has been developed a water-soluble slicing oil agent (Japanese Patent Laid-Open No. Hei 3-181598 or the like). However, in the above water-soluble slicing oil agent, since there is a large change in viscosities caused by evaporation of water contained in the water-soluble slicing oil agent, temperature change, change in shearing rate of a wire saw, and the like, there is a defect that the cutting performance becomes poor. Further, the wafer obtained after cutting an ingot using the above water-soluble slicing oil agent is cleaned with water, and the waste water treatment after cleaning can be carried out by employing, for instance, aggregating sedimentation process, pressurized floatation process, activated sludge process, activated charcoal treatment process, or the like. However, all of these process have defects in that large costs and equipments therefor are necessitated.

In addition, since the abrasive grains which are used for abrasive grains (abrasives and the like) have a remarkably high specific gravity as compared to that of the cutting oil, the abrasive grains having high specific gravity are sedimented from the cutting oil composition in a slurry form, wherein the cutting oil composition comprises the cutting oil and the abrasive grains. Therefore, since the abrasive gains are sedimented inside the tank, pipe, or the like, the content of the abrasive grains is lowered, so that there arise problems that the cutting performance and the cutting accuracy are lowered, and that the sedimented and accumulated abrasive grains form a hard cake when the operation is stopped for a long period of time, thereby making it difficult to uniformly re-disperse the abrasive grains.

DISCLOSURE OF INVENTION

Accordingly, an object of the present invention is to provide a cutting oil which can give excellent dispersibility of an abrasive such as abrasive grains, and give excellent re-dispersibility when sedimented, cutting performance and workability; a cutting oil composition which can facilitate the cleaning of a cut product obtained after cutting; a cutting method using the cutting oil composition; a method of cutting an ingot; and a process for cleaning a wafer with a simple waste water treatment.

Specifically, the present invention relates to:

[1] a cutting oil comprising (a) a polyether compound represented by the formula (I):

$$R_1O(EO)_m(AO)_nR_2 \quad (I)$$

wherein each of $R_1$ and $R_2$, which may be identical or different, is hydrogen atom or a hydrocarbon group having 1 to 24 carbon atoms, at least one of which is a hydrocarbon group; EO is oxyethylene group; AO is an oxyalkylene group having 3 or 4 carbon atoms; and each of m and n is 1 to 50, wherein a sum of m and n is from 4 to 100;

[2] a cutting oil composition comprising the cutting oil of the above item [1] and an abrasive;

[3] a cutting method using the cutting oil composition of the above item [2]; and

[4] a process of cleaning a wafer comprising the steps of cleaning a wafer obtainable by cutting an ingot with a wire saw using the cutting oil composition of the above item [3]; heating the resulting waste water to a temperature equal to or higher than a cloud point of a polyether compound represented by the formula (I):

$$R_1O(EO)_m(AO)_nR_2 \quad (I)$$

wherein each of $R_1$ and $R_2$, which may be identical or different, is hydrogen atom or a hydrocarbon group having 1 to 24 carbon atoms, at least one of which is a hydrocarbon group; EO is oxyethylene group; AO is an oxyalkylene group having 3 or 4 carbon atoms; and each of m and n is 1 to 50, wherein a sum of m and n is from 4 to 100, the polyether compound being contained in waste water, to allow separation into an oil phase and an aqueous phase; and removing the oil s phase comprising the polyether compound from the waste water.

BEST MODE FOR CARRYING OUT THE INVENTION

1. Cutting Oil

In the present specification, the cutting oil has the same meaning as a working fluid used in cutting of an ingot or the like by using a wire saw or the like.

Since the cutting oil of the present invention comprises (a) a polyether compound represented by the formula (I), there are exhibited excellent characteristics that the cutting oil deposited on a sliced product obtained after cutting can be easily cleaned, that the suitability to a material such as a urethane in a wire saw is high, that the change in viscosities of the cutting oil is small, and that the cutting performance is excellent.

In the formula (I), each of $R_1$ and $R_2$ is hydrogen atom, or a hydrocarbon group having 1 to 24 carbon atoms. In addition, $R_1$ and $R_2$ may be identical or different, and at least one of them is a hydrocarbon group, from the viewpoint of reducing the change in viscosities of the cutting oil composition comprising abrasive grains. The number of carbon atoms in the hydrocarbon group is 1 or more, from the viewpoint of sufficiently exhibiting the cutting performance, and the number of carbon atoms is 24 or less, preferably 18 or less, more preferably 12 or less, particularly preferably 6 or less, from the viewpoint of facility in cleaning sliced products obtained after cutting. The hydrocarbon group may be any one of aliphatic hydrocarbon groups and aromatic hydrocarbon groups. In addition, the aliphatic hydrocarbon group may be either saturated or unsaturated, or either linear or branched.

In the formula (I), EO is oxyethylene group, and AO is an oxyalkylene group having 3 or 4 carbon atoms. The oxyalkylene group includes oxypropylene group and oxybutylene group. In addition, in the formula (I), $(EO)_m(AO)_n$ is a random form or a block form, each composed of EO and AO.

Each of the above-mentioned m and n is from 1 to 50, more preferably from 1 to 25, particularly preferably from 1 to 20. It is desired that m is 1 or more, from the viewpoint of facility in cleaning of sliced products obtained after cutting, and that n is 1 or more, from the viewpoint of the low-temperature fluidity of the cutting oil. It is desired that each of m and n is 50 or less, from the viewpoint of the fluidity of the cutting oil composition.

Incidentally, the polyether compound represented by the formula (I) can be obtained by adding an alkylene oxide compound to a monohydric alcohol or phenol using, for example, KOH as a catalyst. When prepared by this process, the numbers of moles added of the oxyethylene group and the oxyalkylene group in the resulting polyether compound have a distribution, and the polyether compound is prepared as a group composed of individual polyether compounds having different numbers of moles added for each of EO and AO. Therefore, the compound represented by the formula (I) may be defined as individual compounds constituting a group of compounds, or as a group of compounds having different numbers of moles added.

In the case where the polyether compound represented by the formula (I) is defined as individual compounds, it is desired that each of m and n is an integer, and that each is an integer of from 1 to 50, preferably from 1 to 25, more preferably from 1 to 20. The polyether compound defined as individual compounds may be used alone or in admixture of two or more kinds.

In addition, in the case where the polyether compound represented by the formula (I) is defined as a group of compounds having different numbers of moles added, it is desired that each of m and n is a number representing an average number of moles added, and that each is a number of from 1 to 50, more preferably from 1 to 25, particularly preferably from 1 to 20. It is desired that in the mixture of the polyether compounds, the individual polyether compounds, in which in the formula (I), each of m and n is an integer of from 1 to 50, preferably from 1 to 25, more preferably from 1 to 20, are contained in an amount of 50% by weight or more, more preferably 70% by weight or more.

The sum of m and n is 4 or more, from the viewpoint of the suitability between the cutting oil and a material such as a urethane, and the sum is 100 or less, more preferably 50 or less, particularly preferably 30 or less, from the viewpoints of reduction in the change in viscosities of the cutting oil composition comprising abrasive grains, and from the viewpoint of the fluidity of the cutting oil composition.

In addition, in a case where the polyether compound represented by the formula (I) is defined as individual compounds, and n is 2 or more, the 2 or more AO may be identical or different. When different, the polyether compound may be in a random form or a block form. In a case where the polyether compound is defined as a group of compounds having different numbers of moles added, when the individual compounds constituting the group of the compounds have 2 or more AO, AO may similarly be identical or different. When different, the polyether compound may be in a random form or a block form.

The cutting oil of the present invention comprises the polyether compound represented by the formula (I) as a main component. In a case where the polyether compound represented by the formula (I) is defined as individual compounds, the content of the polyether compound represented by the formula (I) in the cutting oil is 50% by weight or more, preferably 60% by weight or more, more preferably 70% by weight or more, still more preferably 80% by weight or more, particularly preferably 90% by weight or more. In addition, in a case where the polyether compound represented by the formula (I) is defined as a group of compounds having different numbers of moles added, the content of the polyether compounds represented by the formula (I) as a mixture in the cutting oil is 80% by weight or more, preferably 90% by weight or more.

Since the cutting oil of the present invention comprises a nonionic surfactant which is the polyether compound represented by the formula (I) having a cloud point of from 0° to 100° C. when diluted 20-folds with water, the dispersibility and the facility in cleaning of wafers obtained after cutting can be improved.

It is desired that the cloud point of the polyether compound represented by the formula (I) is preferably 0° C. or higher, more preferably 20° C. or higher, particularly preferably 30° C. or higher, and that the cloud point is preferably 100° C. or lower, more preferably 80° C. or lower, particularly preferably 70° C. or lower, from the viewpoint of the facility in handling during cleaning. The cloud point is preferably from 0° to 100° C., more preferably from 20° to 80° C., particularly preferably from 30° to 70° C.

In addition to the above-mentioned polyether compound represented by the formula (I), additives, for example, a thickener, a dispersant, an anticorrosive, a chelating agent, a basic substance, a surfactant, and the like can be added, as occasion demands, to the cutting oil of the present invention. Even those reactive with the above-mentioned polyether compound may be used for the above-mentioned additives, as long as they do not hinder the object of the present invention.

In addition, when the cutting oil of the present invention containing abrasive grains is used as a cutting oil composition, even those reactive with the abrasive grains may be used for the above-mentioned additives, as long as they do not hinder the object of the present invention.

In the cutting oil of the present invention, a water-soluble organic compound or the like may optionally be used as a medium of the above-mentioned polyether compound represented by the formula (I) and the additives added as occasion demands.

The amount of the above-mentioned optionally used medium may be a balance obtained by subtracting the amounts of the polyether compound represented by the formula (I) and additives added as occasion demands from that of the cutting oil.

In the present invention, a cutting oil further comprising (b) silica particles, in addition to the above-mentioned cutting oil, can further suppress the change in viscosities of the cutting oil, and when an abrasive (abrasive grains) is contained in the cutting oil, there is exhibited an excellent effect that the lowering of the cutting performance owing to sedimentation of the abrasive (abrasive grains) can be suppressed.

The above-mentioned silica particles are silicon dioxide, and concretely includes silica gel, anhydrous silica in the form of ultrafine particles, and the like. It is desired that the particle size of the primary particle of the above-mentioned silica particles is preferably 5 nm or more, more preferably 10 nm or more, from the viewpoint of sufficiently exhibiting the effect of suppressing the sedimentation of abrasive grains, and that the particle size of the primary particle is preferably 50 nm or less, more preferably 20 nm or less, from the viewpoint of the dispersibility to the polyether compound represented by the formula (I). Among them, anhydrous silica is preferable, and concretely includes AEROSIL manufactured by Nippon Aerosil, and the like. Further, it is desired that the anhydrous silica is a hydrophobic silica in which silanol group on the surface of an anhydrous silica is subjected to hydrophobic treatment.

As for the cutting oil of the present invention, in addition to the above-mentioned (a) polyether compound represented by the formula (I) [hereinafter referred to as (a)], (b) silica particles [hereinafter referred to as (b)], there can be further used (c) a surfactant [hereinafter referred to as (c)]. By containing the above-mentioned (a), (b) and (c), there are exhibited an effect that the sedimentation of an abrasive is suppressed, and that an excellent effect that an abrasive can be easily re-dispersed even when the abrasive is sedimented.

The above-mentioned (c) includes one or more kinds of surfactants selected from the group consisting of alkylene oxide adducts of an alkylamine, alkylene oxide adducts of a fatty acid ester of a polyhydric alcohol, and imidazoline surfactants, and these surfactants can be used alone or in admixture of two or more kinds.

The above-mentioned alkylene oxide adducts of an alkylamine include, for example, compounds obtained from an aliphatic amine having 8 to 28 carbon atoms and an alkylene oxide which is ethylene oxide or propylene oxide, wherein the number of moles added of the alkylene oxide is preferably from 1 to 50, more preferably from 1 to 20, and the like.

The above-mentioned alkylene oxide adducts of a fatty acid ester of polyhydric alcohol include, for example, compounds obtained from a polyhydric alcohol, a fatty acid, and an alkylene oxide which is ethylene oxide or propylene oxide, the polyhydric alcohol having in its molecule from 2 to 10 hydroxyl groups, preferably from 2 to 6 hydroxyl groups, and having 2 to 30 carbon atoms, preferably from 2 to 12 carbon atoms, more preferably from 2 to 8 carbon atoms, and the fatty acid being a linear, saturated or unsaturated fatty acid having 8 to 22 carbon atoms, wherein the number of moles added of the alkylene oxide is preferably from 2 to 100 moles, more preferably from 5 to 50 moles, and the like.

The imidazoline surfactants include, for example, imidazoline derivatives obtainable by heating aminoethyl ethanolamine or a polyethylene polyamine with a fatty acid at 200° to 250° C., and the like. The above-mentioned fatty acids are preferably linear, saturated or unsaturated fatty acids having 8 to 22 carbon atoms, more preferably linear, unsaturated fatty acids having 14 to 20 carbon atoms. In the present invention, imidazoline derivatives obtained from a linear, unsaturated fatty acid having 14 to 20 carbon atoms and aminoethyl ethanolamine are particularly preferable.

In the cutting oil comprising the above-mentioned (a) and (b), or the cutting oil further comprising (c), in addition to the above-mentioned (a) and (b), the content of the above-mentioned (a) in the cutting oil is preferably 80% by weight or more, more preferably 90% by weight or more.

In the cutting oil comprising the above-mentioned (a) and (b), or the cutting oil further comprising (c), in addition to the above-mentioned (a) and (b), the content of the above-mentioned (b) in the cutting oil is preferably 0.05% by weight or more, more preferably 0.2% by weight or more, from the viewpoint of suppressing sedimentation of an abrasive (abrasive grains), and the content is preferably 3% by weight or less, more preferably 2% by weight or less, from the viewpoint of ensuring a viscosity capable of sufficiently exhibiting excellent cutting performance.

In addition, when (c) is further contained, the content thereof is preferably 0.05% by weight or more, more preferably 0.1% by weight or more, from the viewpoint of suppressing sedimentation of an abrasive (abrasive grains), and the content is preferably from 7% by weight or less, more preferably 5% by weight or less, from the viewpoint of ensuring a viscosity capable of sufficiently exhibiting excellent cutting performance.

In the cutting oil comprising the above-mentioned (a) and (b), or the cutting oil further comprising (c), in addition to the above-mentioned (a) and (b), other ingredients may optionally be contained besides the above-mentioned (a), (b) and (c). For example, a thickener, a dispersant, an anticorrosive, a chelating agent, a basic substance, and the like may be used. Even those reactive with the essential components may be used as these optional ingredients, as long as these substances can achieve the object of the present invention.

The cutting oil of the present invention can be prepared by agitating the above-mentioned (a), (b) and optional ingredients, or (a), (b), (c) and optional ingredients by means of an agitator such as a homogenizer.

The cutting oil of the present invention can contain water, depending upon the conditions during cutting with a wire saw. When the cutting oil of the present invention contains water, there can be exhibited a cooling effect during cutting with a wire saw.

It is desired that the content of water in the cutting oil of the present invention is 4% by weight or less, preferably 3% by weight or less, from the viewpoint of suppressing the change in viscosities of the cutting oil owing to evaporation of water contained.

The cutting oil of the present invention is allowed to separate into an oil phase and a water phase by heating waste water generated after cleaning to a temperature higher than the cloud point of the polyether compound represented by the formula (I) contained in the waste water, so that there is exhibited an excellent effect that the oil phase comprising the polyether compound represented by the formula (I) can be easily separated from the waste water.

2. Cutting Oil Composition

The cutting oil composition of the present invention comprises the cutting oil of the present invention and an abrasive (abrasive grains).

In the cutting oil composition of the present invention, since the cutting oil of the present invention is used, there are exhibited excellent properties that the cutting oil composition deposited on the sliced product obtained after cutting is easily cleaned, that the suitability with urethane and other materials in the wire saw is high, that there is a small change in viscosities in the cutting oil composition, and that cutting performance is excellent. In addition, in the cutting oil composition of the present invention, when using the cutting oil of the present invention comprising (c) silica particles, there is also exhibited another excellent properly that the lowering of the cutting performance owing to sedimentation of the abrasive (abrasive grains) can be suppressed.

The amount of the cutting oil in the cutting oil composition can be variously selected, depending on slicing (cutting) speed and required qualities such as shape of cutting face. It is desired that the amount of the cutting oil is preferably 30% by weight or more, more preferably 40% by weight or more, and that the amount is preferably 80% by weight or less, more preferably 70% by weight or less, still more preferably not more than 60% by weight. The amount of the cutting oil is preferably from 30 to 80% by weight, more preferably from 40 to 70% by weight, still more preferably from 40 to 60% by weight.

The above-mentioned abrasive (abrasive grains) can be appropriately selected, depending upon the materials for the object to be cut, required qualities, and the like. Abrasive grains in general use for such processes as cutting and grinding can be used. The abrasive grains include, for example, metals, metal or semi-metal carbides, metal or semi-metal nitrides, metal or semi-metal oxides, metal or semi-metal borides, diamond, and the like. The above-mentioned metal or semi-metal elements belong to the Group 3A, 4A, 5A, 3B, 4B, 5B, 6B, 7B or 8B in the Periodic Table. Concretely, the abrasive grains include alumina grains, SiC grains, diamond grains, magnesium oxide grains, cerium oxide grain, zirconium oxide grain, colloidal silica grains, fumed silica grains, and the like. SiC grains are preferable, from the viewpoint of cutting speed, and concretely GC#600 and GC#800, manufactured by Fujimi Incorporated are preferable.

The average particle size of the abrasive can be appropriately selected depending upon materials for the object to be cut, required qualities, and the like, and the average particle size is preferably from 0.5 to 50 $\mu$m.

The concentration of the abrasive grains in the cutting oil composition can be variously selected, depending on the viscosity of the cutting oil composition, slicing (cutting) speed and required qualities such as shape of cutting face. It is desired that the content of the abrasive (abrasive grains) in the cutting oil composition is preferably 80% by weight or less, more preferably 70% by weight or less, still more preferably 60% by weight or less, from the viewpoint of the fluidity of the cutting oil composition, and that the content is 20% by weight or more, more preferably 30% by weight or more, still more preferably 40% by weight or more, from the viewpoint of cutting efficiency. The content is preferably from 20 to 80% by weight, more preferably from 30 to 70% by weight, still more preferably from 40 to 60% by weight.

The cutting oil composition of the present invention can be obtained as a cutting oil composition in the form of a slurry by homogeneously agitating a cutting oil and an abrasive (abrasive grains) by means of a known agitator or the like.

In the cutting oil composition of the present invention, in addition to the above-mentioned cutting oil, there can be added as occasion demands, for example, additives such as a thickener, a dispersant, an anticorrosive, a chelating agent, a basic substance, and a surfactant. Even those reactive with the polyether compound represented by formula (I), which is a nonionic surfactant, or reactive with abrasive (abrasive grains), each being contained in the above-mentioned cutting oil, can be used as the above-mentioned additives, as long as the resulting compound obtained by the reaction does not hinder the object of the present invention.

In the cutting oil composition of the present invention, a water-soluble organic substance or the like may optionally be used as a medium for the above-mentioned cutting oil, the abrasive (abrasive grains), and the above-mentioned additives added as occasion demands.

The amount of the above-mentioned medium which is optionally used may be a balance obtained by subtracting the amounts of the above-mentioned cutting oil, the abrasive (abrasive grains), and the above-mentioned additives added as occasion demands from that of the cutting oil composition.

When the cutting oil composition of the present invention is used, the materials for the object to be cut includes, for example, ingots of silicon single crystals or polycrystals, GaAs, other semiconductors, other ceramics, and the like.

The application for the cutting oil composition of the present invention includes, but is not particularly limited to, cutting an ingot or the like by means of a wire saw, cutting it by means of a blade saw, and the like, and particularly cutting an ingot or the like by means of a wire saw is preferable.

3. Cutting methods

The cutting method using the cutting oil composition of the present invention includes, for example, but is not particularly limited to, a method of cutting an object to be cut by means of a slicing (cutting) tool by employing the cutting oil composition of the present invention. Concretely, in the case of cutting an ingot or the like by means of a wire saw, ingots of silicon single crystals and the like can be efficiently cut by allowing the cutting oil composition of the present invention to deposit on a thin wire having a width of about 180 $\mu$m.

4. Process for Cleaning Wafer

According to the process of cleaning a wafer of the present invention, there can be carried out a process comprising cleaning with water a wafer obtainable by cutting an ingot by means of a wire saw by using the cutting oil composition of the present invention, preferably a cutting oil composition comprising a cutting oil comprising a polyether compound represented by formula (I), which is a nonionic surfactant, the polyether compound having a clouding point of 0° to 100° C. when diluted 20-folds with water; heating the resulting waste water to a temperature equal to or higher than a clouding point of the polyether compound of formula (I) contained in the waste water, to allow separation into an oil phase and an aqueous phase; and removing the oil phase comprising the polyether compound from the waste water.

A process for cleaning a wafer obtainable by cutting an ingot by means of a wire saw by water includes, for example, but is not particularly limited to, immersion method, ultrasonic cleaning method, vibration method, and spraying method, and these processes can be carried out singly or in combination.

The waste water generated after cleaning a wafer by water contains the polyether compound of formula (I) and the abrasive (abrasive grains) contained in the cutting oil composition of the present invention, and the cutting dust and the like generated from cutting an ingot. A method of removing the particles of the above-mentioned abrasive (abrasive grains), cutting dust, and the like, includes, but is not particularly limited to, filtration method, sedimentation method, centrifugation method, floatation method, and distillation method. Filtration method, sedimentation method, and centrifugation method are preferable, from the viewpoint of availability of the industrial apparatus.

The waste water obtained after removing the particles can be separated into an oil phase and an aqueous phase, the oil phase comprising a polyether compound, by heating and keeping the waste water at a temperature equal to higher than a clouding point, preferably at a temperature higher than a clouding point by 5° C. or higher, of the polyether compound represented by formula (I) above. The heating temperature for the waste water when carrying out this separation process varies depending on the polyether compound contained in the cutting oil composition. It is desired that the heating temperature for the waste water is, for example, preferably 20° C. or higher, more preferably 30° C. or higher, and that the heating temperature is preferably 80° C. or lower, more preferably 70° C. or lower. The heating temperature for the waste water is preferably from 20° to 80° C., more preferably from 30° to 70° C.

As a process for removing the separated oil phase comprising the polyether compound represented by formula (I), there can be employed various processes, such as a process of scooping and removing an oil phase collected at a top or bottom of a tank receiving waste water after cleaning or a tank specialized for separation, a process of continuously extracting out an oil phase, and a process utilizing an auxiliary equipment such as a separation membrane.

Hereinbelow, EO is oxyethylene group, and PO is oxypropylene group.

[Experimental Example 1]

Cutting Oil A: Content of the compound (1) represented by $n\text{-}C_4H_9(EO)_{5.3}(PO)_{4.0}H$ [random form, number of moles added being an average value]: 100% by weight Cutting Oil B: Content of the compound (2) represented by $n\text{-}C_4H_9(EO)_{9.2}(PO)_{6.9}H$ [random form, number of moles added being an average value]: 100% by weight Cutting Oil C: Content of the compound (3) represented by $n\text{-}C_{12}H_{25}(EO)_{2.5}(PO)_{2.5}(EO)_{2.5}H$ [block form, number of moles added being an average value]: 100% by weight Cutting Oil a: Content of the compound (4) represented by $HO(EO)_mH$ [average molecular weight: 400]: 100% by weight Cutting Oil b: Content of the compound (5) represented by $HO(PO)_2H$: 100% by weight Cutting Oil c: Content of the compound represented by $n\text{-}C_4H_9(EO)_2H$: 100% by weight Cutting Oil d: Mineral oil-based cutting oil (trade name: "LW-1" manufactured by Palace Chemical Co., Ltd.)

Experiment No. 1

A stainless beaker was charged with 2 parts by weight of Cutting Oil A mentioned above and 3 parts by weight of abrasive grains (manufactured by K. K. Fujimi Incorporated, "GC #800"), and the contents were stirred with a homomixer (manufactured by Tokushu Kika Kogyo Co., Ltd., T. K. Autohomomixer: Model M, agitation impellers: disper impellers) at room temperature and 3000 rpm, to give a cutting oil composition in a slurry state in which the cutting oil and the abrasive grains were homogeneously mixed.

Experiment Nos. 2 and 3

A cutting oil composition was prepared in the same manner as in Experiment No. 1 except for using Cutting Oils B and C mentioned above, respectively, in place of Cutting Oil A in Experiment No. 1.

Experiment Nos. 4 to 6

Using the compounds (1) to (3) mentioned above, 20-folds diluted aqueous solutions were prepared, respectively.

Experiment Nos. 7 to 10

A cutting oil composition was prepared in the same manner as in Experiment No. 1 except for using Cutting Oils a to d mentioned above, respectively, in place of Cutting Oil A in Experiment No. 1.

Experiment Nos. 11 and 12

Using the compounds (4) and (5) in place of the compounds (1) to (3) in Experiment Nos. 4 to 6, 20-folds diluted aqueous solutions were prepared, respectively.

EXAMPLE 1-1

Rate of Change in Viscosity by High-Speed Agitation

Using each of the cutting oil compositions obtained in Experiment Nos. 1–3, 7 and 10 mentioned above and agitating at 3000 rpm using the above homomixer, the change in viscosities with the passage of time was evaluated by determining the viscosities before and after the test. The viscosity was determined at 25° C. under the conditions of sample: 500 g of a cutting oil composition; a sample temperature; 50° C.; and agitation time period: 10 hours by using B-type viscometer (manufactured by Tokyo Keili K. K.). The results are shown in Table 1. In Table 1, the rate of change in viscosities is calculated by:

$$\frac{\text{Viscosity After Test (After 10-Hour Agitation)}}{\text{Viscosity Before Test}} \times 100,$$

which shows that the closer the value of the rate of change in viscosities to 100, the smaller the change in viscosities.

TABLE 1

| | Cutting Oil | Rate of Change in Viscosities |
|---|---|---|
| Experiment No. 1 | A | 102% |
| Experiment No. 2 | B | 98% |
| Experiment No. 3 | C | 80% |
| Experiment No. 7 | a | 172% |
| Experiment No. 10 | d | 58% |

As shown in Table 1, as compared to cases where the cutting oil compositions of Experiment Nos. 7 and 10 each comprising the conventional cutting oil were used, in cases where the cutting oil compositions of Experiment Nos. 1 to 3 each comprising the cutting oil of the present invention were used, it was shown that since the values for the rate of change in viscosities were closer to 100%, the change in viscosities by high-speed agitation was small.

EXAMPLE 1-2

Rate of Change in Viscosities by Change in Shearing Rate

Using each of the cutting oil compositions obtained in Experiment Nos. 1–3, 7 and 8 mentioned above, the change in viscosities with a change in the shearing rate was evaluated by a rotational viscometer (manufactured by HAAKE, Model "ROTOVISCO RV12"). The change in viscosities was determined under the conditions of detector head: M500; rotor: MV2; measuring temperature: 25° C.; highest shearing speed: 500 $s^{-1}$ (keeping for 3 minutes); rate of change in shearing speed: 0 to 500 $s^{-1}$/3 minutes. The results are shown in Table 2. In Table 2, after determining the viscosity at a shearing speed of 500 $s^{-1}$ and the viscosity at a shearing speed of 100 $s^{-1}$, the rate of change in viscosities is calculated by:

$$\frac{\text{Viscosity at Shearing Speed of 500 } s^{-1}}{\text{Viscosity at Shearing Speed of 100 } s^{-1}} \times 100,$$

which shows that the closer the value of the rate of change in viscosities to 100, the smaller the change in viscosities.

TABLE 2

| | Cutting Oil | Rate of Change in Viscosities |
|---|---|---|
| Experiment No. 1 | A | 90% |
| Experiment No. 2 | B | 80% |
| Experiment No. 3 | C | 81% |
| Experiment No. 7 | a | 53% |
| Experiment No. 8 | b | 51% |

As shown in Table 2, as compared to cases where the cutting oil compositions of Experiment Nos. 7 and 8 each comprising the conventional cutting oil were used, in cases where the cutting oil compositions of Experiment Nos. 1 to 3 each comprising the cutting oil of the present invention were used, it was shown that since the values for the rate of change in viscosities were closer to 100%, the change in viscosities by the change in shearing rate was small.

EXAMPLE 1-3:

Rate of Change in Weight and Rate of Change in Volume

Using each of the cutting oils A to C and c mentioned above, 100 cc of the cutting oil was taken into a 200 cc beaker. A urethane piece having no hollow holes (manufactured by Nippon Testpanel Osaka Co. Ltd., W 20 mm×D 50 mm×H 2 mm) was immersed therein, and allowed to stand for 1 day at 60° C. Thereafter, the rate of change in weight and the rate of change in volume for the urethane piece before and after the test were determined, and the suitability of the cutting oil to the urethane material used for a guide roller of a wire was evaluated. The results are shown in Table 3. In Table 3, "+" indicates an increase with respect to each of the weights and volumes before the test. In Table 3, smaller values of the rate of change in weight and the rate of change in volume indicate smaller effects of the cutting oil on the urethane material and higher suitability to the urethane material.

TABLE 3

| Cutting Oil | Rate of Change in Weight | Rate of Change in Volume |
|---|---|---|
| A | +18% | +20% |
| B | +6% | +7% |
| C | +19% | +22% |
| c | +49% | +53% |

As shown in Table 3, in contrast to a case of using the conventional cutting oil c where each of the rate of change in weight and the rate of change in volume was about 50%, in cases of using the cutting oils of the present invention where the rate of change in weight and the rate of change in volume were almost 20% or less, it was shown that the effects on the urethane material were small, and that a suitability to the urethane material is high.

EXAMPLE 1-4:

Detergency

A cloud point of each of 20-fold diluted aqueous solutions prepared in Experiment Nos. 4 to 6 and 11 and 12 was determined. Each of the 20-fold diluted aqueous solutions was kept at 60° C. for 30 minutes, and the detergency was evaluated using the presence or absence of oil-water separation as an index. The results are shown in Table 4. The cloud point refers to a temperature at which the liquid starts to become turbid when 10 to 30 ml of a 20-fold diluted aqueous solution is taken into a test tube, and when the temperature is raised at a heating rate of 1° C./minute.

TABLE 4

| | 20-Fold Diluted Aqueous Solutions | Cloud Point (° C.) | Presence or Absence of Oil-Water Separation |
|---|---|---|---|
| Experiment No. 4 | Compound (1) | 55 | Presence |
| Experiment No. 5 | Compound (2) | 52 | Presence |
| Experiment No. 6 | Compound (3) | 37 | Presence |
| Experiment No. 11 | Compound (4) | >100 | Absence |
| Experiment No. 12 | Compound (5) | >100 | Absence |

From the results shown in Table 4, in cases of Experiment Nos. 4 to 6 where an ingot was cut using any of the cutting oils comprising the compounds (1) to (3), and thereafter the resulting wafer was cleaned, since when the generated waste water was heated to a temperature equal to or higher than the cloud point, the oil-water separation was caused by the cutting oil dissolved in waste water, it was suggested that the waste water treatment can be easily carried out. On the other hand, in cases of Experiment Nos. 11 and 12 where the cutting oils comprising the compounds (4) and (5) were used, a cloud point was not detected even if the 20% diluted aqueous solution was heated to 100° C., and the oil-water separation was not caused, suggesting that the waste water generated after cleaning cannot be simply treated.

Further, assuming that a sliced product was cleaned with water, the sliced product being obtained by cutting an ingot by means of a wire saw using each of the cutting oil compositions obtained in Experiment Nos. 1 to 3 and 10 mentioned above, the dissolving state of the cutting oil composition of the present invention in water was visually observed using as an index for the detergency. The results are shown in Table 5.

TABLE 5

| | Cutting Oil | Dissolving State |
|---|---|---|
| Experiment No. 1 | A | Homogeneously Transparent |
| Experiment No. 2 | B | Homogeneously Transparent |
| Experiment No. 3 | C | Homogeneously Transparent |
| Experiment No. 10 | d | White Turbid |

As shown in Table 5, as compared to the case where a cutting oil became white turbid when using the conventional mineral oil-based cutting oil of Experiment No. 10, the cutting oils became homogeneously transparent when each of the cutting oils of Experiment Nos. 1 to 3 was used. Therefore, when the cutting oils of Experiment Nos. 1 to 3 were used, it was shown that the sliced product after cutting was easily cleaned.

[Experimental Example 2]

As (a) the polyether compounds, the following ones were used:

A-1: n-$C_4H_9O(EO)_{6.4}(PO)_{3.2}H$ [random form, number of moles added being an average value]

A-2: n-$C_{12}H_{25}O(EO)_{2.5}(PO)_{2.5}(EO)_{2.5}H$ [block form, number of moles added being an average value]

As (b) the silica particles, one manufactured by Nippon Aerosil under the trade name: "AEROSIL RY200S" (hydrophobic silica; average particle size of primary particles: 16 nm) was used.

As (c) the surfactants, the following ones were used:

C-1: One manufactured by Kao Corporation, AMIET 105 (Polyoxyethylene alkyl amine)

C-2: One manufactured by Kao Corporation, RHEODOL 440 (Polyoxyethylene sorbitol tetraoleate)

C-3: One manufactured by Kao Corporation, HOMOGENOL L-95 (imidazoline surfactant)

Experiment Nos. 13 to 23

Each of the cutting oils having the composition shown in Table 6 was prepared by agitating with a homogenizer at 10,000 rpm for 15 minutes.

TABLE 6

| Experiment | Polyether Compound (% By Weight) | | Silica Particles | Surfactant (% By Weight) | | |
|---|---|---|---|---|---|---|
| No. | A-1 | A-2 | (% By Weight) | C-1 | C-2 | C-3 |
| 13 | 99 | — | 1 | — | — | — |
| 14 | — | 99 | 1 | — | — | — |
| 15 | 98 | — | 2 | — | — | — |
| 16 | 98 | — | 1 | 1 | — | — |
| 17 | — | 98 | 1 | — | 1 | — |
| 18 | 98 | — | 1 | — | — | 1 |
| 19 | 98 | — | 1 | 0.5 | — | 0.5 |
| 20 | — | 98 | 1 | — | 0.5 | 0.5 |
| 21 | 97.8 | — | 1 | 1 | — | 0.2 |
| 22 | 100 | — | — | — | — | — |
| 23 | — | 100 | — | — | — | — |

EXAMPLE 2-1

Dispersibility and Re-Dispersibility of Abrasive Grains

A 200-ml beaker was charged with 100 parts by weight of SiC abrasive grains [manufactured by K. K. Fujimi Incorporated, under the trade name: GC#600] as abrasive grains and 100 parts by weight (50% by weight in an entire cutting oil composition) of one of the cutting oils shown in Table 6, and the mixture was agitated by using a homomixer (manufactured by Tokushu Kika Kogyo Co., Ltd., Model T. K. Autohomomixer; agitation impellers: disper impellers) at room temperature and 3000 rpm for 3 minutes, to prepare 80 ml of a cutting oil composition in a slurry form in which the cutting oil and the abrasive grains were homogeneously mixed. The resulting cutting oil composition was placed in a 100-ml sample vial.

After the preparation, the dispersibility of the abrasive grains was evaluated by the sedimentation state of the abrasive grains with the passage of time (1 hour, 24 hours, 48 hours).

$$\left[\text{Dispersibility (\%)} = \frac{\text{Volume of Abrasive Grain Layer At Measurement}}{\text{Volume of Cutting Oil Composition At Preparation}} \times 100\right]$$

Here, the abrasive grain layer refers to a layer comprising abrasive grains after removing a transparent layer formed by sedimentation of abrasive grains from the cutting oil composition. The results are shown in Table 7. It is shown in Table 7 that the closer the numerical values of the dispersibility to 100%, the more excellent the dispersibility. In addition, the fluidity of the abrasive grain layer 48 hours after the preparation, and the re-dispersibility were evaluated, the re-dispersibility being evaluated under the following evaluation criteria by slanting a sample 48 hours after the preparation of the cutting oil composition:

Evaluation Criteria

◎: at slanting the sample vial, an entire abrasive grain layer smoothly flows.

○: at slanting the sample vial, an entire abrasive grain layer gradually flows.

□: at slanting the sample vial, only the upper abrasive grain layer flows.

Δ: at slanting the sample vial, flow of an entire abrasive grain layer is slow.

TABLE 7

| Experiment | Dispersibility of Abrasive Grains (%) | | | Re-Dispersibility of Abrasive Grains |
|---|---|---|---|---|
| No. | 1 hour | 24 hours | 48 hours | 48 hours |
| 13 | 97 | 72 | 67 | ○ |
| 14 | 96 | 71 | 65 | □ |
| 15 | 99 | 81 | 72 | ○ |
| 16 | 99 | 82 | 72 | ◎ |
| 17 | 99 | 80 | 70 | ◎ |
| 18 | 99 | 84 | 75 | ◎ |
| 19 | 99 | 90 | 85 | ◎ |
| 20 | 99 | 88 | 80 | ◎ |
| 21 | 99 | 89 | 84 | ◎ |
| 22 | 90 | 51 | 50 | Δ |
| 23 | 91 | 50 | 49 | Δ |

It is shown from the results of Table 7 that each of the cutting oil composition of Experiment Nos. 13 to 21 each comprising the silica particles has more excellent dispersibility of the abrasive grains, as compared to the cutting oil composition of Experiment Nos. 22 and 23 without containing the silica particles, and that the dispersibility is maintained over a longer period of time. In addition, in each of the cutting oil compositions of Experiment Nos. 13 to 21 each comprising the silica particles, the abrasive grain layer maintains the fluidity after the passage of 48 hours after the preparation of the cutting oil composition, whereby showing easy re-dispersibility.

EXAMPLE 2-2

Detergency of Wafer After Cutting

Assuming that the wafer obtained by cutting an ingot by means of a wire saw using the cutting oil composition is cleaned by water, the detergency of the cut wafer on which the cutting oil composition was deposited was evaluated by using a glass wafer cut into a size of 8 inches with a wire saw and the cutting oil composition.

The cutting oil composition was obtained by agitating 50 parts by weight of the cutting oil of Experiment No. 16 and 50 parts by weight of the abrasive grains GC#600 as abrasive grains in the same manner as in Example 2-1 into a slurry form.

Three sheets of the 8 inch-glass wafers were laminated so as to have a gap of 300 μm, and the cutting oil composition was immersed in the gap between the glass wafers. Next, there were repeated 10 times an operation of immersing the resulting cutting oil composition-immersed glass wafers in water for 10 seconds, and taking out from water into the air and allowing the solution to drip off for 10 seconds. Thereafter, the cleaning state of the wafer on which the cutting oil composition was deposited was observed. The detergency was evaluated by the detergent rate. The results are shown in Table 8. In Table 8, the detergent rate was calculated by:

$$\text{Detergent Rate (\%)} = \frac{\text{Wafer Area} - \text{Area of Remaining Cutting Oil Composition in Wafer}}{\text{Wafer Area}} \times 100$$

In addition, a similar test was carried out by using polyethylene glycol [average molecular weight: 400], which is a conventionally used water-soluble cutting oil (Experiment No. 24).

TABLE 8

| | Detergent Rate (%) |
|---|---|
| Experiment No. 16 | 98 |
| Experiment No. 24 | 70 |

It is shown from the results of Table 8, the cutting oil composition of Experiment No. 16 can be more easily cleaned and removed by water, as compared to the cutting oil composition using the conventional cutting oil of Experiment No. 24. The cutting oil composition of Experiment No. 16 containing the silica particles shows excellent detergency.

INDUSTRIAL APPLICABILITY

In the cutting oil of the present invention, since the dispersibility of the abrasive grains such as abrasives is excellent, there is exhibited an excellent effect that excellent cutting performance is obtained by a wire saw. In addition, in the cutting oil composition comprising the cutting oil of the present invention and abrasive grains, even when the abrasive grains such as abrasives are sedimented when allowed to stand for a long period of time, the abrasive grains have fluidity, so that there is exhibited an effect that the re-dispersibility of the abrasive grains is facilitated. Further, according to the present invention, the suitability to such materials as urethanes in the wire saw is high, the change in viscosities is small, the cutting performance is excellent, and there can be cut an ingot for which cleaning with water of sliced plates after cutting is easy.

What is claimed is:

1. A cutting oil, comprising:

(a) a polyether compound represented by the formula (I):

$$R_1O(EO)_m(AO)_nR_2$$

wherein each of $R_1$ and $R_2$, which may be identical or different, is hydrogen atom or a hydrocarbon group having 1 to 24 carbon atoms, at least one of which is a hydrocarbon group; EO is oxyethylene group; AO is an oxyalkylene group having 3 or 4 carbon atoms; and each of m and n is 1 to 50, wherein a sum of m and n is from 4 to 100; and (b) silica particles having a particle size of a primary particle of between 5 nm or more and 50 nm or less.

2. The cutting oil according to claim 1, further comprising (c) one or more surfactants selected from the group consisting of alkylene oxide adducts of alkylamines, alkylene oxide adducts of fatty acid esters of polyhydric alcohols, and imidazoline surfactants.

3. The cutting oil according to any one of claim 1 or 2, wherein said polyether compound represented by the formula (I) is contained in an amount of 60% by weight or more, and wherein a water content is 4% by weight or less.

4. A cutting oil composition comprising the cutting oil of claim 1 and an abrasive.

5. A cutting method using the cutting oil composition of claim 4.

6. The cutting method according to claim 5, wherein an ingot is cut-off by using a wire saw.

7. The cutting oil according to claim 1, wherein said silica particles are anhydrous silica.

8. The cutting oil according to claim 7, wherein said anhydrous silica is a hydrophobic silica.

9. The cutting oil according to claim 1, wherein said silica particles are contained in an amount of 0.05% by weight or more and 3% by weight or less.

10. A cutting oil composition comprising the cutting oil of claim 2 and an abrasive.

11. A cutting oil composition comprising the cutting oil of claim 3 and an abrasive.

12. The cutting oil according to claim 1, wherein said polyether compound represented by the formula (I) has a cloud point of 0° to 100° C., when the polyether compound is diluted with water 20 times.

13. A process of cleaning a wafer, comprising the steps of cleaning a wafer obtainable by cutting an ingot with a wire saw using the cutting oil composition of claim 6; heating the resulting waste water to a temperature equal to or higher than a cloud point of a polyether compound represented by the formula (I):

$$R_1O(EO)_m(AO)_nR_2 \quad \text{(I)}$$

wherein each of $R_1$ and $R_2$, which may be identical or different, is hydrogen atom or a hydrocarbon group having 1 to 24 carbon atoms, at least one of which is a hydrocarbon group; EO is oxyethylene group; AO is an oxyalkylene group having 3 or 4 carbon atoms; and each of m and n is 1 to 50, wherein a sum of m and n is from 4 to 100, the polyether compound being contained in the waste water, to allow separation into an oil phase and an aqueous phase; and removing the oil phase comprising the polyether compound from the waste water.

* * * * *